US010013997B2

(12) United States Patent
Sherwood et al.

(10) Patent No.: US 10,013,997 B2
(45) Date of Patent: Jul. 3, 2018

(54) ADAPTIVE INTERCHANNEL DISCRIMINATIVE RESCALING FILTER

(71) Applicant: Cirrus Logic Inc., Austin, TX (US)

(72) Inventors: Erik Sherwood, Salt Lake City, UT (US); Carl Grundstrom, Sandy, UT (US)

(73) Assignee: Cirrus Logic, Inc., Austin, TX (US)

( * ) Notice: Subject to any disclaimer, the term of this patent is extended or adjusted under 35 U.S.C. 154(b) by 73 days.

(21) Appl. No.: 14/938,816

(22) Filed: Nov. 11, 2015

(65) Prior Publication Data

US 2016/0133272 A1 May 12, 2016

Related U.S. Application Data

(60) Provisional application No. 62/078,844, filed on Nov. 12, 2014.

(51) Int. Cl.
*G10L 21/0232* (2013.01)
*G10L 21/0208* (2013.01)
(Continued)

(52) U.S. Cl.
CPC ..... *G10L 21/0232* (2013.01); *G10L 21/0208* (2013.01); *G10L 25/84* (2013.01); *G10L 2021/02165* (2013.01)

(58) Field of Classification Search
CPC . G10L 21/0232; G10L 21/0208; G10L 25/84; G10L 2021/02165
See application file for complete search history.

(56) References Cited

U.S. PATENT DOCUMENTS 6,584,204 B1 * 6/2003 Al-Ali ..... H03G 3/32 381/94.3
7,171,003 B1 1/2007 Venkatesh et al.
(Continued)

OTHER PUBLICATIONS

United States Internaitonal Searching Authority; International Search Report & Written Opinion issued for PCT/US2015/060337 dated Mar. 7, 2016; Alexandria, VA; US.
(Continued)

*Primary Examiner* — Qian Yang
(74) *Attorney, Agent, or Firm* — Dorius Law PC; Kirk Dorius

(57) ABSTRACT

A method for adjusting a degree of filtering applied to an audio signal includes modeling a probability density function (PDF) of a fast Fourier transform (FFT) coefficient of a primary channel and reference channel of the audio signal; maximizing at least one of PDFs to provide a discriminative relevance difference (DRD) between a noise magnitude estimate of the reference channel and a noise magnitude estimate of the primary channel. The method further includes emphasizing the primary channel when the spectral magnitude of the primary channel is stronger than the spectral magnitude of the reference channel; and deemphasizing the primary channel when the spectral magnitude of the reference channel is stronger than the spectral magnitude of the primary channel. The emphasizing and deemphasizing includes computing a multiplicative rescaling factor and applying the multiplicative rescaling factor to a gain computed in a prior stage of a speech enhancement filter chain when there is a prior stage, and directly applying a gain when there is no prior stage.

20 Claims, 8 Drawing Sheets

(51) Int. Cl.
*G10L 21/0216* (2013.01)
*G10L 25/84* (2013.01)

(56) References Cited

U.S. PATENT DOCUMENTS

| | | | | |
|---|---|---|---|---|
| 2003/0206674 | A1 | 11/2003 | Altman et al. | |
| 2012/0226691 | A1 | 9/2012 | Edwards | |
| 2013/0054231 | A1 | 2/2013 | Jeub et al. | |
| 2014/0025374 | A1* | 1/2014 | Lou | G10L 21/0216 704/203 |
| 2014/0029762 | A1 | 1/2014 | Xie et al. | |

OTHER PUBLICATIONS

Pasha et al; "Closed form Filtering for Linear Fractional Transformation Models"; proceedings of the 17th World Congress; IFAC, Jul. 6-11, 2008; 6 pages; retrieved from URL: < http://www.nt.ntnu.no/users/skoge/prost/proceedings/ifac2008/data/papers/2777.pdf >.

Lu et al.; "Speech Enhancement by Combining Statistical Estimators of Speech and Noise"; ICASP 2010; 4 pages; retrieved from URL: < http://www.mirlab.org/conference_papers/International?cConference/ICASSP%202010/pdfs/0004754.pdf >.

* cited by examiner

ADAPTIVE INTERCHANNEL DISCRIMINATIVE RESCALING FILTER

CROSS-REFERENCE TO RELATED APPLICATION

This patent application claims priority to U.S. provisional application Ser. No. 62/078,844 filed Nov. 12, 2014 and titled "Adaptive Interchannel Discriminative Rescaling Filter," which is incorporated herein in its entirety by reference.

TECHNICAL FIELD

This disclosure relates generally to techniques for processing audio signals, including techniques for isolating voice data, removing noise from audio signals, or otherwise enhancing the audio signals prior to outputting the audio signals. Apparatuses and systems for processing audio signals are also disclosed.

BACKGROUND

A variety of audio devices, including state of the art mobile telephones, include a primary microphone that is positioned and oriented to receive audio from an intended source, and a reference microphone that is positioned and oriented to receive background noise while receiving little or no audio from the intended source. In many usage scenarios, the reference microphone provides an indicator of the amount of noise that is likely to be present in a primary channel of an audio signal obtained by the primary microphone. In particular, the relative spectral power levels, for a given frequency band, between the primary and reference channel may indicate whether that frequency band is dominated by noise or by signal in the primary channel. The primary channel audio in that frequency band may then be selectively suppressed or enhanced accordingly.

It is the case, however, that the probability of speech (respectively, noise) dominance in the primary channel, considered as a function of the unmodified relative spectral power levels between the primary and reference channels, may vary by frequency bin and may not be stationary over time. Thus the use of a raw power ratios, fixed thresholds, and/or fixed rescaling factors in interchannel comparison-based filtering may well result in undesirable speech suppression and/or noise amplification in the primary channel audio.

Accordingly, improvements are sought in estimating the differences in noise-dominant/speech-dominant power levels between input channels, and in suppressing noise and enhancing speech presence in the primary input channel.

SUMMARY OF THE INVENTION

One aspect of the invention features, in some embodiments, a method for transforming an audio signal. The method includes obtaining a primary channel of an audio signal with a primary microphone of an audio device; obtaining a reference channel of the audio signal with a reference microphone of the audio device; estimating a spectral magnitude of the primary channel of the audio signal for a plurality of frequency bins; and estimating a spectral magnitude of the reference channel of the audio signal for a plurality of frequency bins. The method further includes transforming one or more of the spectral magnitudes for one or more frequency bins by applying at least one of a fractional linear transformation and a higher order rational functional transformation; and further transforming one or more of the spectral magnitudes for one or more frequency bins. The further transformation can include one or more of: renormalizing one or more of the spectral magnitudes; exponentiating one or more of the spectral magnitudes; temporal smoothing of one or more of the spectral magnitudes; frequency smoothing of one or more of the spectral magnitudes; VAD-based smoothing of one or more of the spectral magnitudes; psychoacoustic smoothing of one or more of the spectral magnitudes; combining an estimate of a phase difference with one or more of the transformed spectral magnitudes; and combining a VAD-estimate with one or more of the transformed spectral magnitudes.

In some embodiments, the method includes updating at least one of the fractional linear transformation and the higher order rational functional transformation per bin based on augmentative inputs.

In some embodiments, the method includes combining at least one of an a priori SNR estimate and an a posteriori SNR estimate with one or more of the transformed spectral magnitudes.

In some embodiments, the method includes combining signal power level difference (SPLD) data with one or more of the transformed spectral magnitudes.

In some embodiments, the method includes calculating a corrected spectral magnitude of the reference channel based on a noise magnitude estimate and a noise power level difference (NPLD). In some embodiments, the method includes calculating a corrected spectral magnitude of the primary channel based on the noise magnitude estimate and the NPLD.

In some embodiments, the method includes at least one of replacing one or more of the spectral magnitudes by weighted averages taken across neighboring frequency bins within a frame and replacing one or more of the spectral magnitudes by weighted averages taken across corresponding frequency bins from previous frames.

Another aspect of the invention features, in some embodiments, a method for adjusting a degree of filtering applied to an audio signal. The method includes obtaining a primary channel of an audio signal with a primary microphone of an audio device; obtaining a reference channel of the audio signal with a reference microphone of the audio device; estimating a spectral magnitude of the primary channel of the audio signal; and estimating a spectral magnitude of the reference channel of the audio signal. The method further includes modeling a probability density function (PDF) of a fast Fourier transform (FFT) coefficient of the primary channel of the audio signal; modeling a probability density function (PDF) of a fast Fourier transform (FFT) coefficient of the reference channel of the audio signal; maximizing at least one of a single channel PDF and a joint channel PDF to provide a discriminative relevance difference (DRD) between a noise magnitude estimate of the reference channel and a noise magnitude estimate of the primary channel; and determining which of the spectral magnitudes is greater for a given frequency. The method further includes emphasizing the primary channel when the spectral magnitude of the primary channel is stronger than the spectral magnitude of the reference channel; deemphasizing the primary channel when the spectral magnitude of the reference channel is stronger than the spectral magnitude of the primary channel; and wherein the emphasizing and deemphasizing include computing a multiplicative rescaling factor and applying the multiplicative rescaling factor to a gain computed in a prior stage of a speech enhancement filter chain when there is a prior stage, and directly applying a gain when there is no prior stage.

In some embodiments, the multiplicative rescaling factor is used as a gain.

In some embodiments, the method includes including an augmentative input with each spectral frame of at least one of the primary and reference audio channels.

In some embodiments, the augmentative input includes estimates of an a priori SNR and an a posteriori SNR in each bin of the spectral frame for the primary channel. In some embodiments, the augmentative input includes estimates of the per-bin NPLD between corresponding bins of the spectral frames for the primary channel and the reference channel. In some embodiments, the augmentative input includes estimates of the per-bin SPLD between corresponding bins of the spectral frames for the primary channel and reference channel. In some embodiments, the augmentative input includes estimates of a per frame phase difference between the primary channel and the reference channel.

Another aspect of the invention features, in some embodiments, an audio device, including a primary microphone for receiving an audio signal and for communicating a primary channel of the audio signal; a reference microphone for receiving the audio signal from a different perspective than the primary microphone and for communicating a reference channel of the audio signal; and at least one processing element for processing the audio signal to filter and or clarify the audio signal, the at least one processing element being configured to execute a program for effecting any of the methods described herein.

BRIEF DESCRIPTION OF THE DRAWINGS

A more complete understanding of the present invention may be derived by referring to the detailed description when considered in connection with the Figures.

DETAILED DESCRIPTION

Figure 1:
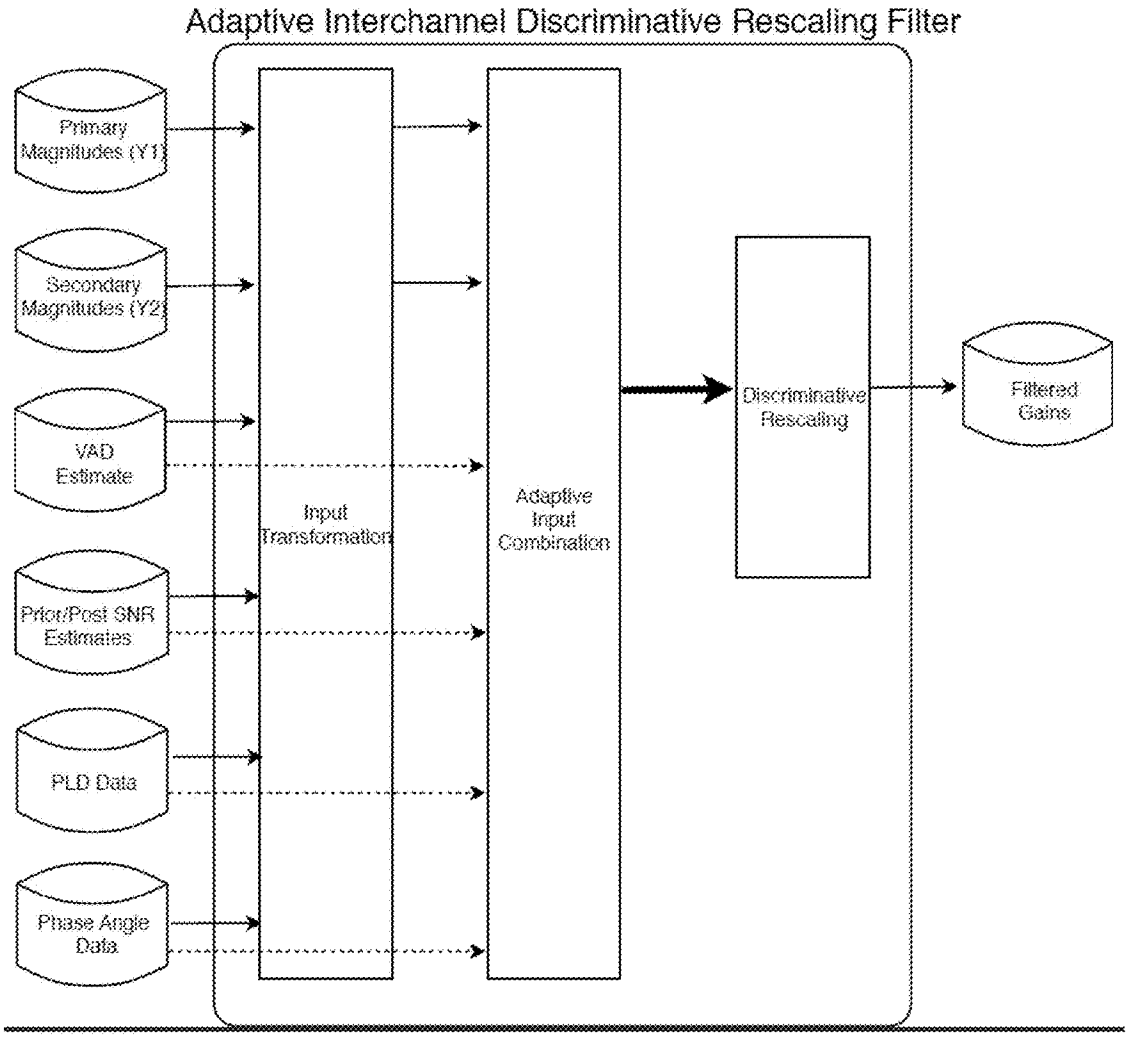
FIG. 1 illustrates an adaptive interchannel discriminative rescaling filter process according to one embodiment.

The following description is of exemplary embodiments of the invention only, and is not intended to limit the scope, applicability or configuration of the invention. Rather, the following description is intended to provide a convenient illustration for implementing various embodiments of the invention. As will become apparent, various changes may be made in the function and arrangement of the elements described in these embodiments without departing from the scope of the invention as set forth herein. Thus, the detailed description herein is presented for purposes of illustration only and not of limitation.

Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

The present invention extends to methods, systems, and computer program products for analyzing digital data. The digital data analyzed may be, for example, in the form of digital audio files, digital video files, real time audio streams, and real time video streams, and the like. The present invention identifies patterns in a source of digital data and uses the identified patterns to analyze, classify, and filter the digital data, e.g., to isolate or enhance voice data. Particular embodiments of the present invention relate to digital audio. Embodiments are designed to perform non-destructive audio isolation and separation from any audio source.

The purpose of the Adaptive Interchannel Discriminative Rescaling (AIDR) filter is to adjust the degree of filtering of the spectral representation of the input from the primary microphone, which is presumed to contain more power from the desired signal than power from noise, based on the relevance-adjusted relative power levels of the primary and reference spectra, $Y_1$ and $Y_2$, respectively. The input from the reference microphone is presumed to contain more relevance-adjusted power from confounding noise than from the desired signal.

If it is detected that the secondary microphone input tends to contain more speech than the primary microphone input (e.g. the user is holding the phone in a reversed orientation), then the expectation regarding the relative magnitudes of $Y_1$ and $Y_2$ will also be reversed. Then in the following description, the roles of $Y_1$ and $Y_2$, etc., are simply interchanged, with the exception that the gain modifications may continue to be applied to $Y_1$.

The logic of the AIDR filter, roughly speaking, is that for a given frequency, when the reference input is stronger than the primary input, then the corresponding spectral magnitude in the primary input represents more noise than signal and should be suppressed (or at least not accentuated). When the relative strengths of the reference and primary input are reversed, the corresponding spectral magnitude in the primary input represents more signal than noise and should be accentuated (or at least not suppressed).

However, accurately determining whether a given spectral component of the primary input is in fact "stronger" than its counterpart in the reference channel, in a manner relevant for noise suppression/speech enhancement contexts, typically requires one or both of the primary and reference spectral inputs be algorithmically transformed to a suitable form. Following transformation, filtering and noise suppression is effected via discriminative rescaling of the spectral components of the primary input channel. This suppression/enhancement is typically achieved by computing a multiplicative rescaling factor to be applied to gains computed in prior stages of a speech enhancement filter chain, although the rescaling factors may also be used as gains themselves with appropriate choice of parameters.

1 Filter Inputs

A diagrammatic overview of the multistage estimation and discrimination process of the AIDR filter is presented in FIG. 1. Time-domain signals $y_1, y_2$ from the primary and secondary (reference) microphones are presumed to have been processed into equal length frames of samples upstream from the AIDR filter, $y_i(s,t)$, where $i \in \{1, 2\}$, s=0, 1, . . . is the sample index within the frame and t=0, 1, . . . is the frame index. These sample frames will have been further converted to the spectral domain via Fourier transform, so that $y_i \rightarrow Y_i$ with $Y_i(k,m)$ indicating the k-th discrete frequency component ("bin") of the m-th spectral frame, where k=1, 2, . . . , K and m=0, 1, . . . . Note that K, the number of frequency bins per spectral frame, is typically determined according to the sampling rate in the time domain, e.g. 512 bins for a sampling rate of 16 kHz. $Y_1(k,m)$ and $Y_2(k,m)$ are considered necessary inputs to the AIDR filter.

If the AIDR filter is incorporated into a speech enhancement filter chain following other processing components, augmentative inputs carrying additional information may accompany each spectral frame. Particular example inputs of interest (used in different filter variants) include 1. Estimates of the a priori SNR $\xi(k,m)$ and a posteriori SNR $\eta(k,m)$ in each bin of the spectral frame for the primary signal. These values will typically have been computed by a previous statistical filtering stage, e.g. MMSE, Power Level Difference (PLD), etc. These are vector inputs of the same length as $Y_i$.
2. Estimates of $\alpha_{NPLD}(k,m)$, the per-bin noise power level difference (NPLD) between corresponding bins of the spectral frames for the primary and secondary signals. These values will have been computed by the PLD Filter. These are vector inputs of the same length as $Y_i$.
3. Estimates of $\alpha_{NPLD}(k,m)$, the per-bin speech power level difference (SPLD) between corresponding bins of the spectral frames for the primary and secondary signals. These values will have been computed by the PLD Filter. These are vector inputs of the same length as $Y_i$.
4. Estimates of $S_1$ and/or $S_2$, the probabilities of speech presence in the primary and secondary signals, computed by a previous voice activity detection (VAD) stage. It is assumed that scalars $S_i \in [0, 1]$.
5. Estimates of $\Delta\phi(m)$, the phase angle separation between the spectra of the primary and reference inputs in the m-th frame, as provided by a suitable prior processing stage, e.g. PHAT (phase transform), GCC-PHAT (generalized cross-correlation with phase transform), etc.

2 Stage 1a: Input Transformation

Figure 2:
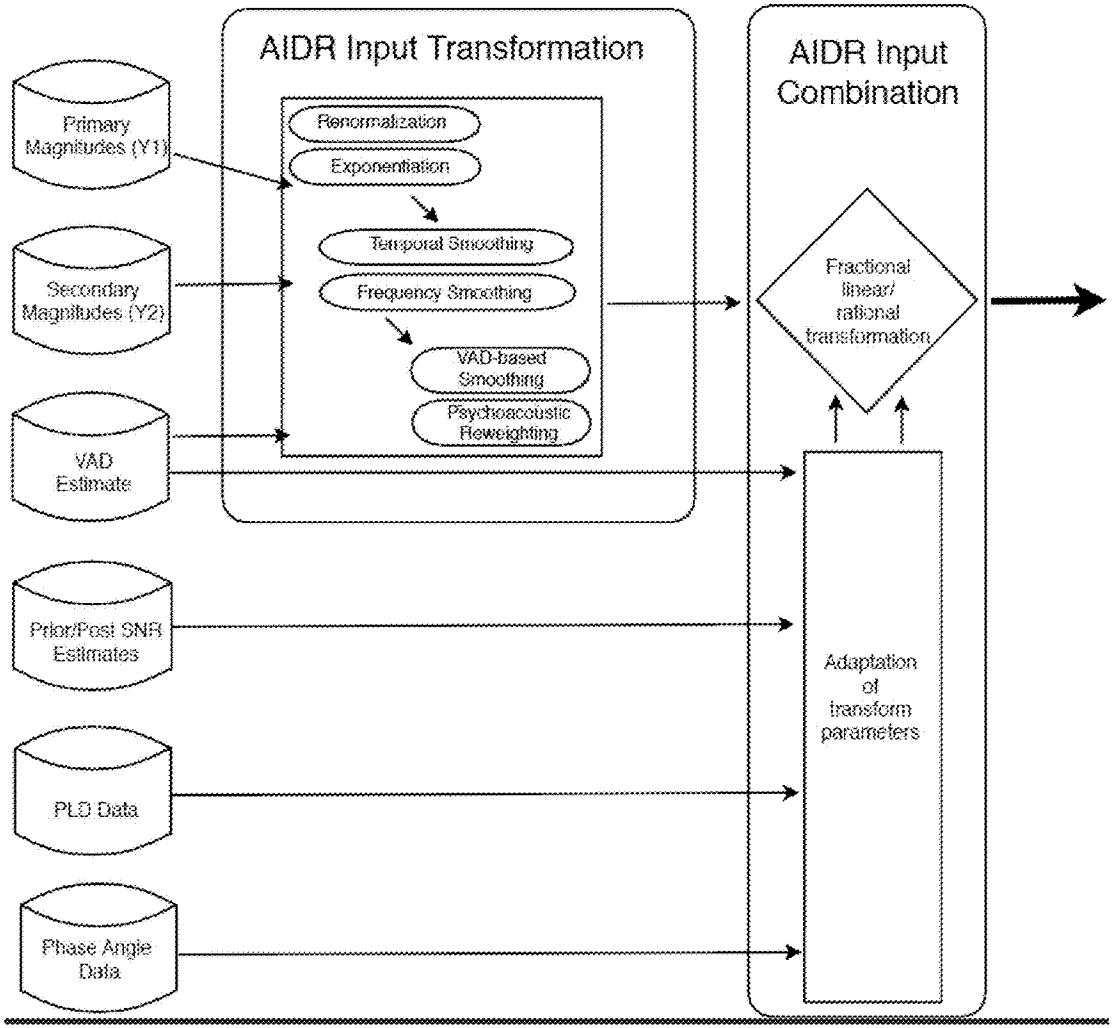
FIG. 2 illustrates input transformations for use in adaptive interchannel discriminative rescaling filter process according to one embodiment.
Figure 3:
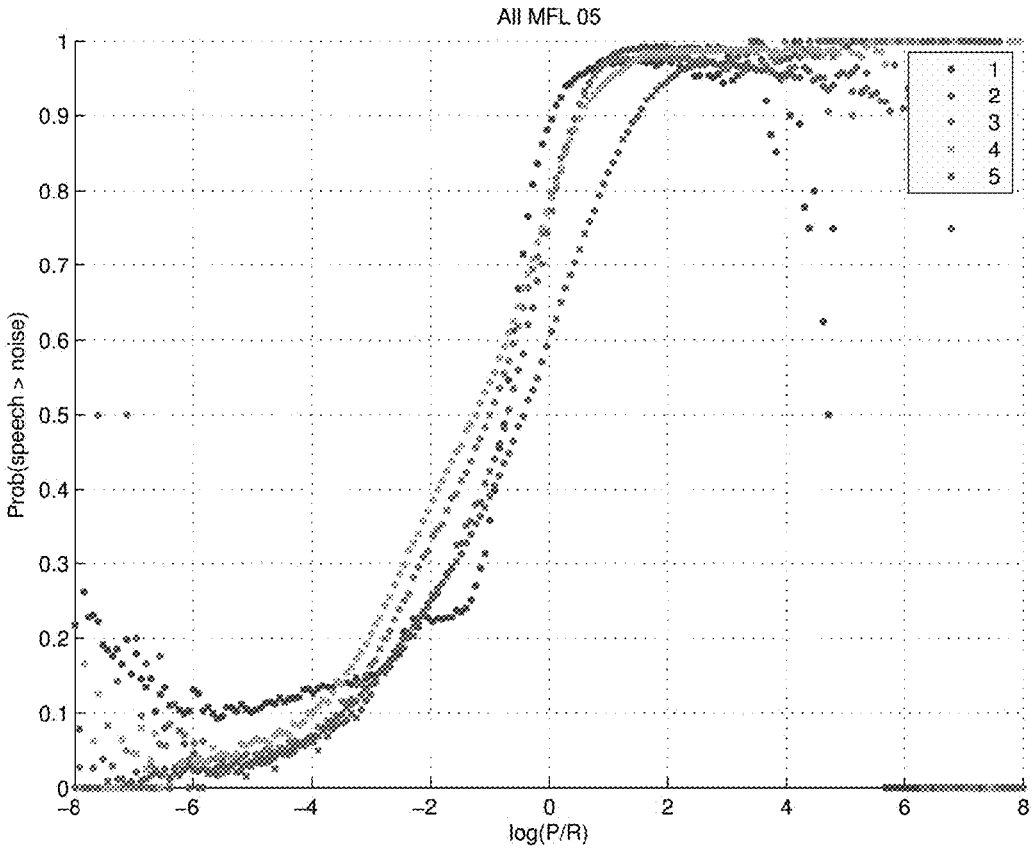
FIG. 3 illustrates a comparison of noise and speech power levels according to one embodiment.
Figure 4:
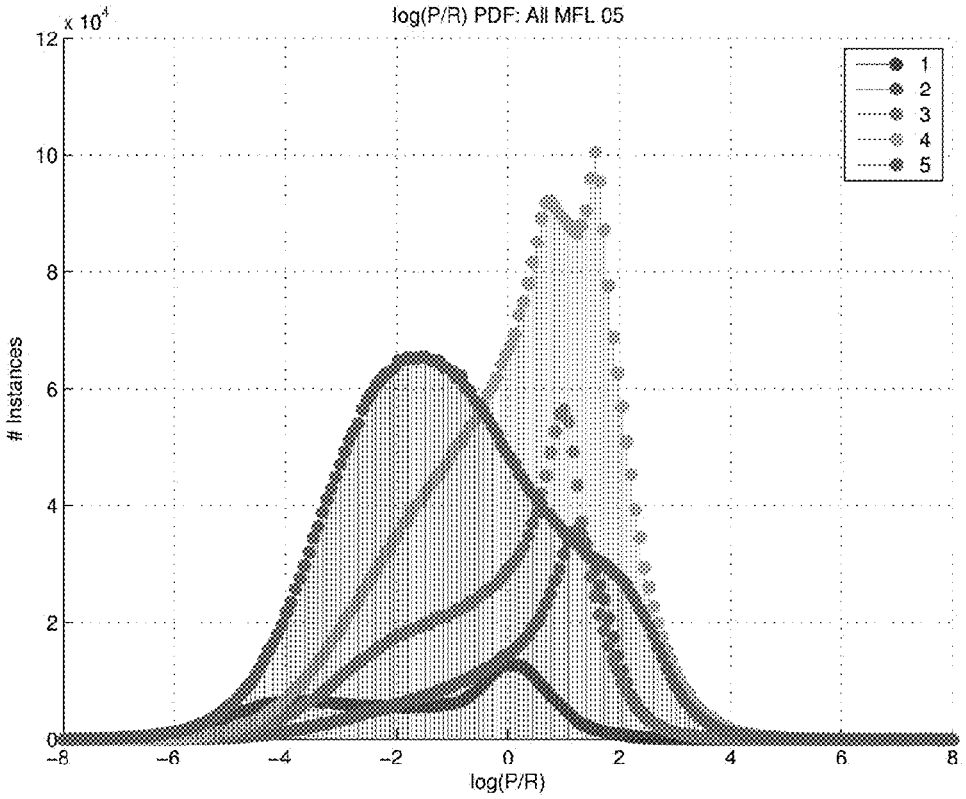
FIG. 4 illustrates an estimation of noise and speech power level probability distribution functions according to one embodiment.
Figure 5:
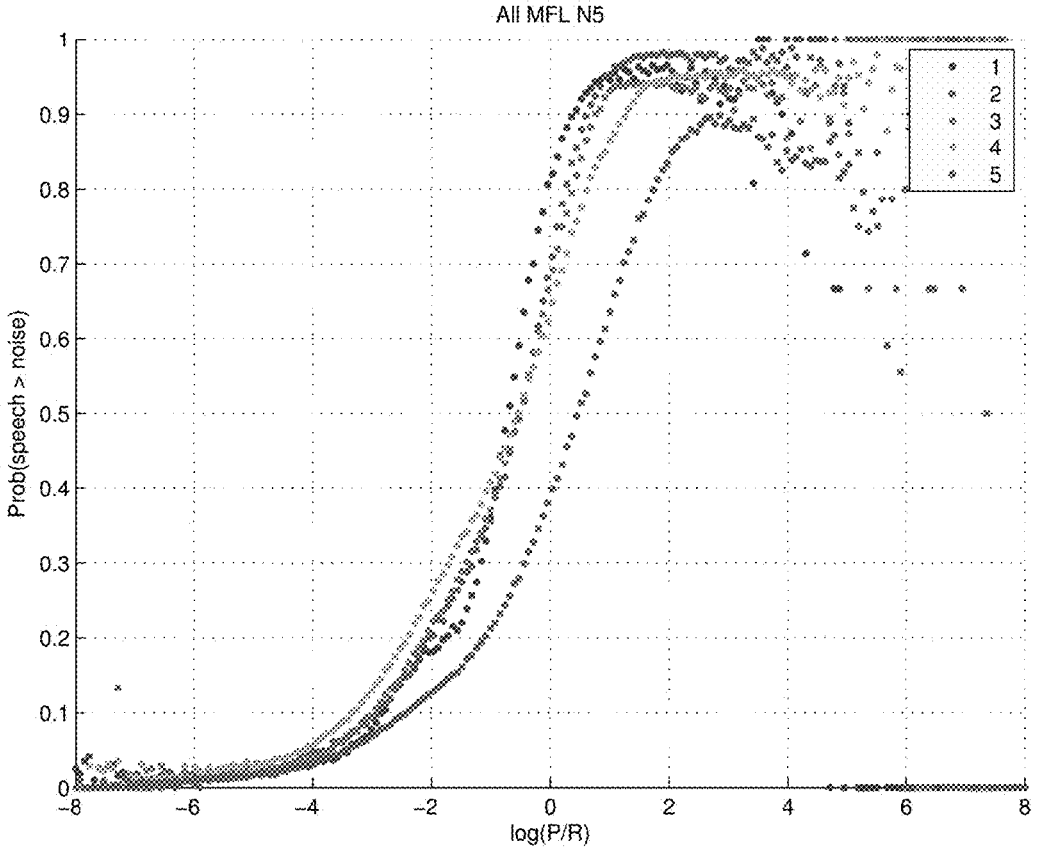
FIG. 5 illustrates a comparison of noise and speech power levels according to one embodiment.
Figure 6:
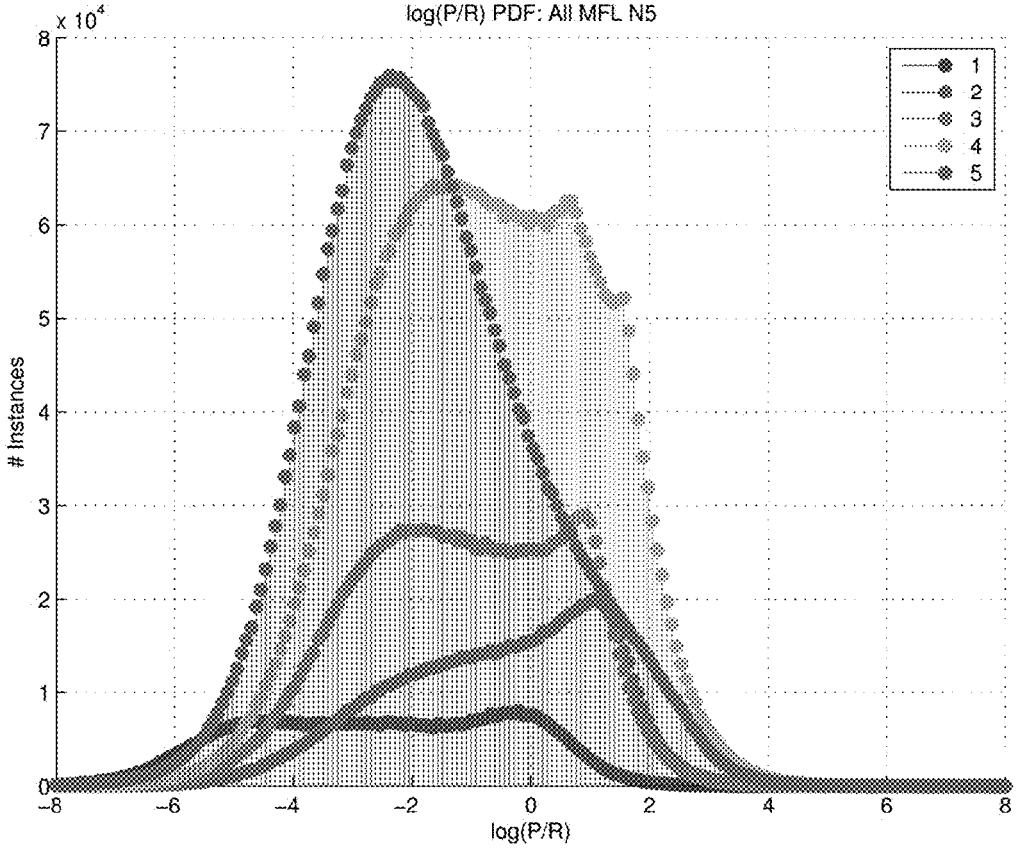
FIG. 6 illustrates an estimation of noise and speech power level probability distribution functions according to one embodiment.

The necessary inputs $Y_i$ are combined into a single vector for use in discriminative rescaling (stage 2), as will be described shortly. An expanded diagram of the input transformation and combination process of the AIDR filter is presented in FIG. 2. This combination process does not necessarily act on the magnitudes $Y_i(k,m)$ directly, rather the raw magnitudes may first be transformed into more suitable representations $\overline{Y}_i(k,m)$ which act, for example, to smooth out temporal and inter-frequency fluctuations or reweight/rescale the magnitudes in a frequency-dependent manner.

Prototypical transformations ("Stage 1 Preprocessing") include

1. Renormalization of the magnitudes, e.g.

$$\overline{Y}_i(k,m) = \frac{Y(k,m)}{\sum_{i=1}^{K} Y(k,m)}.$$

2. Raising of magnitudes to a power, i.e. $\overline{Y}_i(k,m) = Y_i(k,m)^{p_i}$. Note that $p_i$ may be negative, may not necessarily be integer-valued, and $p_1$ may not equal $p_2$. One effect of such a transformation, for appropriately chosen $p_i$, could be to accentuate differences by raising spectral peaks and flattening spectral troughs within a given frame.
3. Replacement of the magnitudes by weighted averages taken across neighboring frequency bins within a frame. This transformation provides a local smoothing in frequency and can help reduce negative effects of musical noise that may have been introduced in prior processing steps which may have already edited the FFT magnitudes. As an example, the magnitude Y(k,m) may be replaced by the weighted average of its value and the values of magnitudes of the adjacent frequency bins via $$\overline{Y}(k,m) = \begin{cases} \dfrac{\sum_{i=-1}^{1} w_k(i+1)Y(k+i,m)}{\sum_{j=1}^{3} w_k(j)} & \text{if } k = 2, \ldots, K-1 \\ \dfrac{\sum_{i=0}^{1} w_k(i+1)Y(k+i,m)}{\sum_{j=2}^{3} w_k(j)} & \text{if } k = 1 \\ \dfrac{\sum_{i=-1}^{0} w_k(i+1)Y(k+i,m)}{\sum_{j=1}^{2} w_k(j)} & \text{if } k = K \end{cases}$$

where $w_k = (1, 2, 1)$ is a vector of frequency bin weights. The subscript k is included for w to acknowledge the possibility that the weighting vector for the local average could be different for different frequencies, e.g. narrower for low frequencies, broader for high frequencies. The weighting vector need not be symmetric about the k-th (central) bin. For instance, it may be skewed to weight more heavily bins above (in both bin index and corresponding frequency) the central bin. This may be useful during voiced speech to place emphasis on bins near the fundamental frequency and its higher harmonics.
4. Replacement of the magnitudes by weighted averages taken across corresponding bins from previous frames. This transformation provides temporal smoothing within each frequency bin and can help reduce negative effects of musical noise that may have been introduced in prior processing steps that may have already edited the FFT magnitudes. Temporal smoothing may be implemented in various ways. For example a) Simple weighted averaging:

$$\bar{Y}(k,m)=\begin{cases}\dfrac{\sum_{i=-2}^{0} w_k(i+3)Y(k,m+i)}{\sum_{j=1}^{3} w_k(j)}, & w=(1,2,3)\text{ if } m\geq 2\\ \dfrac{\sum_{i=-1}^{0} w_k(i+2)Y(k,m+i)}{\sum_{j=1}^{3} w_k(j)} & \text{if } m=1\\ Y(k,m) & \text{if } m=0\end{cases}$$

b) Exponential smoothing:

$$\bar{Y}(k,m)=\begin{cases}Y(k,m) & \text{if } m=0\\ \beta Y(k,m)+(1-\beta)\bar{Y}(k,m-1) & \text{if } m>0\end{cases}$$

Here $\beta\in[0, 1]$ is a smoothing parameter which determines the relative weighting of bin magnitudes from the current frame relative to previous frames.

5. Exponential smoothing with VAD-based weighting: It can also be useful to perform temporal smoothing in which bin magnitudes from only those prior frames which do/do not contain speech information are included. This requires sufficiently accurate VAD information (augmentative input) computed by a prior signal processing stage. VAD information may be incorporated into exponential smoothing as follows:

a)

$$\bar{Y}(k,m)=\begin{cases}Y(k,m) & \text{if } m=0\\ \beta Y(k,m)+(1-\beta)\bar{Y}(k,m^*) & \text{if } m>0\end{cases}$$

In this variant, $m^*<m$ is the index of most recent prior frame such that $S_i(m^*)$ is above (or below) a specified threshold indicating speech presence/absence.

b) Alternatively, the probability of speech presence may be used to modify the smoothing rate directly:

$$\bar{Y}(k,m)=\begin{cases}Y(k,m) & \text{if } m=0\\ \beta(S_i)Y(k,m)+(1-\beta(S_i))\bar{Y}(k,m^*) & \text{if } m>0\end{cases}$$

In this variant, $\beta$ is a function of $S_i$, e.g. a sigmoid function with parameters chosen such that as $S_i$ moves below (resp. above) a given threshold, $\beta(S_i)$ approaches a fixed value $\beta_a$ (resp. $\beta_b$).

6. Reweighting according to psychoacoustic importance: mel-frequency and ERB-scale weighting.

Note that any and/or all of the above stages may be combined, or some stages may be omitted, with their respective parameters adjusted according to application (e.g. mel-scale reweighting used for automatic speech recognition but not mobile telephony).

3 Stage 1b: Adaptive Input Combination

The final output of the input transformation stage for frame index m is designated as u(m). Note that u(m) is a vector having the same length K as $Y_i$, and u(k,m) indicates the component of u associated with the k-th discrete frequency component of the m-th spectral frame. The computation of u(m) requires the modified necessary inputs $\bar{Y}_1$, $\bar{Y}_2$, and in general form this is accomplished by a vector-valued function f: $\mathbb{R}^{2K}\rightarrow\mathbb{R}^K$, $f(\bar{Y}_1(m), \bar{Y}_2(m))=u(m)$.

In its simplest implementation, the per-bin action of f on $\bar{Y}_1(k,m)$, $\bar{Y}_2(k,m)$ may be expressed as a fractional linear transformation:

$$f_k(\bar{Y}_1(k,m),\bar{Y}_2(k,m))=u(k,m)=\frac{A_k\bar{Y}_1(k,m)+B_k}{C_k\bar{Y}_2(k,m)+D_k}$$

Without loss of generality, larger values of u(k,m) may be presumed to indicate that in the kth frequency bin there is more power from the desired signal than from the confounding noise at time index m.

More generally, the numerator and denominator of $f_k$ may instead involve higher order rational expressions in $\bar{Y}_1(k,m)$, $\bar{Y}_2(k,m)$:

$$f_k(\bar{Y}_1(k,m),\bar{Y}_2(k,m))=u(k,m)=\frac{\sum_{i=0}^{Q} A_{i,k}(\bar{Y}_1(k,m))^i}{\sum_{j=0}^{R} C_{j,k}(\bar{Y}_2(k,m))^j}$$

Furthermore, any piecewise smooth transformation may be represented within any desired order of accuracy with this general representation (Chisholm approximant). In addition, the transformation parameters ($A_k$, $B_k$, $C_k$, $D_k$, or $A_{i,k}$, $C_{j,k}$ in these example) may vary by frequency bin. For example, it can be useful to use different parameters for bins in lower versus higher frequency bands in cases where the expected noise power characteristics are different in lower versus higher frequencies.

In practice, the parameters of $f_k$ are not fixed but rather are updated from frame to frame based on augmentative inputs, e.g.

$$B_k=B_k(\alpha_{NPLD}(k,m),\xi(k,m),\eta(k,m),S_1(m),\Delta\phi(m)), \quad (1)$$

$$D_k=D_k(\alpha_{NPLD}(k,m),S_1(m),\Delta\phi(m)) \quad (2)$$

or $$A_{i,k}=A_{i,k}(\alpha_{NPLD}(k,m),\xi(k,m),\eta(k,m),S_1(m),\Delta\phi(m)), \quad (3)$$

$$C_{j,k}=C_{j,k}(\alpha_{NPLD}(k,m),S_1(m),\Delta\phi(m)) \quad (4)$$

and so forth.

The adjustments to the raw inputs $Y_1(k,m)$, $Y_2(k,m)$ effect a per-bin transformation of raw spectral power estimates to quantities more relevant to the purpose of discriminating which components of the input $Y_1(k,m)$ are predominantly relevant to the desired signal. The transformations may act, for example, to rescale relative peaks and troughs in the primary and/or reference spectra, to smooth (or sharpen) spectral transients, and/or to correct for differences in orientation or spatial separation between the primary and reference microphones. As such factors may change over time, the relevant parameters of the transformation are typically updated once per frame while the AIDR filter is active.

4 Stage 2: Discriminative Rescaling

The aim of the second stage is to filter noise components from the primary signal by reducing those $Y_1(k,m)$ magnitudes which are estimated to contain more noise than desired speech. The output of stage 1, u(m), serves as this estimate. If we take the output of stage 2 to be a vector of multiplicative gains for each frequency component of $Y_1(m)$, then the kth gain should be small (close to 0) when u(k,m) indicates a very low SNR and large (near 1, e.g. if gains are restricted to be non-constructive) if u(k,m) indicates a very high SNR. For the intermediate cases, it is desirable for there to be a gradual transition between these extremes.

Phrased generally, in the second step of the filter, the vector u is converted piecewise-smoothly into a vector w in such fashion that small values $u_k$ are mapped to small values $w_k$ and large values $u_k$ are mapped to larger non-negative values $w_k$. Here k indicates frequency bin index. This transformation is achieved via the vector-valued function g: $\mathbb{R}^N \rightarrow \mathbb{R}^N$ giving g(u)=w. Element-wise, g is described by non-negative piecewise smooth functions $g_k$: $\mathbb{R} \rightarrow \mathbb{R}$. It may well be the case that $0 \leq w_k \leq B_k$, for some finite $B_k$, but g need neither be bounded nor non-negative. Each $g_k$ should, however, be finite and non-negative over the plausible range of inputs $u_k$.

A prototypical example of g features the simple sigmoid function $$g_k(u(k,m)) = w_k = \alpha_k + \frac{\beta_k}{1 + \exp(-\delta_k u(k,m) - \epsilon_k)}$$

in each coordinate.

The generalized logistic function is more flexible:

$$g_k(u(k,m)) = w_k = \alpha_k + \frac{\beta_k - \alpha_k}{(1 + \gamma_k \exp(-\delta_k(u(k,m) - \mu_k)))^{\nu_k}}$$

The parameter $\alpha_k$ sets the minimum value for $w_k$. It is typically chosen to be a small positive value, e.g. 0.1, to avoid total suppression of Y(k,m).

The parameter $\beta_k$ is the primary determinant of the maximum value for $w_k$, and it is generally set to 1, so that high SNR components are not modified by the filter. For some applications, however, $\beta_k$ may be made slightly larger than 1. When the AIDR is used as a post-processing component in a larger filtering algorithm, for example, and prior filtering stages tend to attenuate the primary signal (either globally or in particular frequency bands), then $\beta_k > 1$ may act to restore some speech components that were previously suppressed.

The output of $g_k$ in the transitional, intermediate range of u(k,m) values is determined by parameters $\delta_k$, $v_k$, and $\mu_k$ which control the degree, abscissa, and ordinate of maximum slope.

Initial values of these parameters are determined by examining the distribution of u(k,m) values for a variety of speakers under a wide range of noise conditions and comparing the u(k,m) values to the relative power levels of noise and speech. These distributions may vary substantially with mixing SNR and noise type; there is less variation between speakers. There are also clear differences between (psychoacoustic/frequency) bands. Examples of probability distributions for noise vs. speech power levels within various frequency bands are shown in FIG. 3-6.

Figure 7:
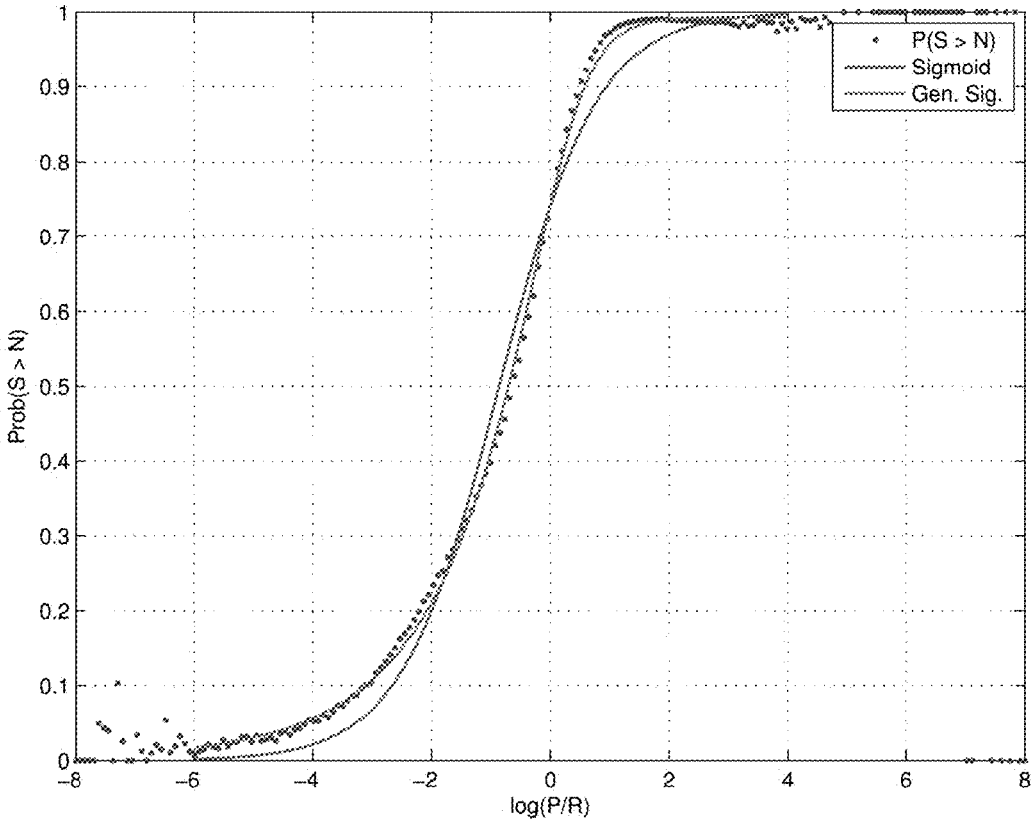
FIG. 7 illustrates comparison of noise and speech power levels with estimates of discriminative gain functions according to one embodiment.

The empirical curves thus obtained are well-matched by the generalized logistic functions. The generalized logistic function provides the best fits, though the simple sigmoid is often adequate. FIG. 7 shows a basic sigmoid function and a generalized logistic function fit to empirical probability data. A single 'best' parameter set can be found by aggregating many speakers and noise types, or parameter sets may be adapted to specific speakers and noise types.

5 Additional Notes

For convenience, $\bar{u}(k,m)$ may be substituted for u(k,m) in the (generalized) logistic function of Stage 2. This has the effect of concentrating values that may range over several orders of magnitude into a much smaller interval. The same end result may be achieved without resort to taking logarithms of the function input, however, by rescaling and algebraic recombination of parameter values using logarithms.

Parameter values in Stage 2 may adjust on a "decision-directed basis" within fixed limits.

The vector w may be used either as a standalone vector of multiplicative gains to be applied to the spectral magnitudes of the primary input, or it may be used a scaling and/or shifting factor for gains computed in prior filtering stages.

When used a standalone filter, the AIDR filter provides basic noise suppression using the modified relative levels of spectral powers as an ad hoc estimate of a priori SNR and the sigmoidal function as a gain function.

Embodiments of the present invention may also extend to computer program products for analyzing digital data. Such computer program products may be intended for executing computer-executable instructions upon computer processors in order to perform methods for analyzing digital data. Such computer program products may comprise computer-readable media which have computer-executable instructions encoded thereon wherein the computer-executable instructions, when executed upon suitable processors within suitable computer environments, perform methods of analyzing digital data as further described herein.

Embodiments of the present invention may comprise or utilize a special purpose or general-purpose computer including computer hardware, such as, for example, one or more computer processors and data storage or system memory, as discussed in greater detail below. Embodiments within the scope of the present invention also include physical and other computer-readable media for carrying or storing computer-executable instructions and/or data structures. Such computer-readable media can be any available media that can be accessed by a general purpose or special purpose computer system. Computer-readable media that store computer-executable instructions are computer storage media. Computer-readable media that carry computer-executable instructions are transmission media. Thus, by way of example, and not limitation, embodiments of the invention can comprise at least two distinctly different kinds of computer-readable media: computer storage media and transmission media.

Computer storage media includes RAM, ROM, EEPROM, CD-ROM or other optical disk storage, magnetic disk storage or other magnetic storage devices, or any other physical medium which can be used to store desired program code means in the form of computer-executable instructions or data structures and which can be accessed by a general purpose or special purpose computer.

A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer, the computer properly views the connection as a transmission medium. Transmission media can include a network and/or data links which can be used to carry or transmit desired program code means in the form of computer-executable instructions and/or data structures which can be received or accessed by a general purpose or special purpose computer. Combinations of the above should also be included within the scope of computer-readable media.

Further, upon reaching various computer system components, program code means in the form of computer-executable instructions or data structures can be transferred automatically from transmission media to computer storage media (or vice versa). For example, computer-executable instructions or data structures received over a network or data link can be buffered in RAM within a network interface module (e.g., a "NIC"), and then eventually transferred to computer system RAM and/or to less volatile computer storage media at a computer system. Thus, it should be understood that computer storage media can be included in computer system components that also (or possibly primarily) make use of transmission media.

Computer-executable instructions comprise, for example, instructions and data which, when executed at a processor, cause a general purpose computer, special purpose computer, or special purpose processing device to perform a certain function or group of functions. The computer executable instructions may be, for example, binaries which may be executed directly upon a processor, intermediate format instructions such as assembly language, or even higher level source code which may require compilation by a compiler targeted toward a particular machine or processor. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the invention may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, pagers, routers, switches, and the like. The invention may also be practiced in distributed system environments where local and remote computer systems, which are linked (either by hardwired data links, wireless data links, or by a combination of hardwired and wireless data links) through a network, both perform tasks. In a distributed system environment, program modules may be located in both local and remote memory storage devices.

Figure 8:
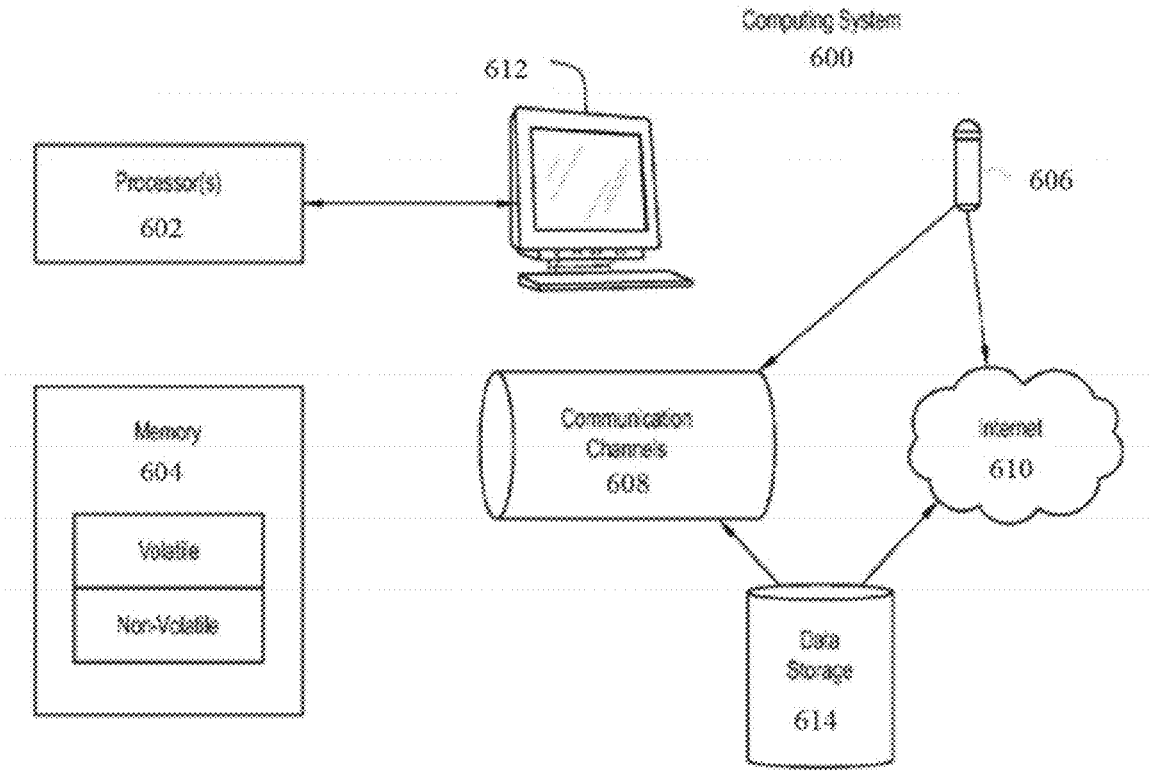
FIG. 8 illustrates a computer architecture for analyzing digital audio data.

With reference to FIG. 8 an example computer architecture 600 is illustrated for analyzing digital audio data. Computer architecture 600, also referred to herein as a computer system 600, includes one or more computer processors 602 and data storage. Data storage may be memory 604 within the computing system 600 and may be volatile or nonvolatile memory. Computing system 600 may also comprise a display 612 for display of data or other information. Computing system 600 may also contain communication channels 608 that allow the computing system 600 to communicate with other computing systems, devices, or data sources over, for example, a network (such as perhaps the Internet 610). Computing system 600 may also comprise an input device, such as microphone 606, which allows a source of digital or analog data to be accessed. Such digital or analog data may, for example, be audio or video data. Digital or analog data may be in the form of real time streaming data, such as from a live microphone, or may be stored data accessed from data storage 614 which is accessible directly by the computing system 600 or may be more remotely accessed through communication channels 608 or via a network such as the Internet 610.

Communication channels 608 are examples of transmission media. Transmission media typically embody computer-readable instructions, data structures, program modules, or other data in a modulated data signal such as a carrier wave or other transport mechanism and include any information-delivery media. By way of example, and not limitation, transmission media include wired media, such as wired networks and direct-wired connections, and wireless media such as acoustic, radio, infrared, and other wireless media. The term "computer-readable media" as used herein includes both computer storage media and transmission media.

Embodiments within the scope of the present invention also include computer-readable media for carrying or having computer-executable instructions or data structures stored thereon. Such physical computer-readable media, termed "computer storage media," can be any available physical media that can be accessed by a general purpose or special purpose computer. By way of example, and not limitation, such computer-readable media can comprise physical storage and/or memory media such as RAM, ROM, EEPROM, CD-ROM or other optical disk storage, magnetic disk storage or other magnetic storage devices, or any other physical medium which can be used to store desired program code means in the form of computer-executable instructions or data structures and which can be accessed by a general purpose or special purpose computer.

Computer systems may be connected to one another over (or are part of) a network, such as, for example, a Local Area Network ("LAN"), a Wide Area Network ("WAN"), a Wireless Wide Area Network ("WWAN"), and even the Internet 110. Accordingly, each of the depicted computer systems as well as any other connected computer systems and their components, can create message related data and exchange message related data (e.g., Internet Protocol ("IP") datagrams and other higher layer protocols that utilize IP datagrams, such as, Transmission Control Protocol ("TCP"), Hypertext Transfer Protocol ("HTTP"), Simple Mail Transfer Protocol ("SMTP"), etc.) over the network.

Other aspects, as well as features and advantages of various aspects, of the disclosed subject matter should be apparent to those of ordinary skill in the art through consideration of the disclosure provided above, the accompanying drawings and the appended claims.

Although the foregoing disclosure provides many specifics, these should not be construed as limiting the scope of any of the ensuing claims. Other embodiments may be devised which do not depart from the scopes of the claims. Features from different embodiments may be employed in combination.

Finally, while the present invention has been described above with reference to various exemplary embodiments, many changes, combinations and modifications may be made to the embodiments without departing from the scope of the present invention. For example, while the present invention has been described for use in speech detection, aspects of the invention may be readily applied to other audio, video, data detection schemes. Further, the various elements, components, and/or processes may be implemented in alternative ways. These alternatives can be suitably selected depending upon the particular application or in consideration of any number of factors associated with the implementation or operation of the methods or system. In addition, the techniques described herein may be extended or modified for use with other types of applications and systems. These and other changes or modifications are intended to be included within the scope of the present invention.

What is claimed:

1. A method for transforming an audio signal comprising:

obtaining a primary channel of an audio signal with a primary microphone of an audio device; obtaining a reference channel of the audio signal with a reference microphone of the audio device;

estimating spectral magnitudes of each of the primary channel and reference channel of the audio signal for a plurality of frequency bins;

transforming one or more of the spectral magnitudes of the primary channel and of the reference channel by applying at least one of a fractional linear transformation and a higher order rational functional transformation to produce one or more transformed spectral magnitudes of the primary channel and of the reference channel;

emphasizing the primary channel when the transformed spectral magnitude of the primary channel is stronger than the transformed spectral magnitude of the reference channel;

deemphasizing the primary channel when the transformed spectral magnitude of the reference channel is stronger than the transformed spectral magnitude of the primary channel;

wherein the emphasizing and deemphasizing include computing a multiplicative resealing factor and applying the multiplicative rescaling factor to a gain computed in a prior stage of a speech enhancement filter chain when there is a prior stage, and directly applying a gain when there is no prior stage; and wherein the emphasizing and deemphasizing adjust a degree of filtering to isolate the voice data in the audio signal and to thereby enhance output of the voice data.

2. The method of claim 1, further comprising updating at least one of the fractional linear transformation and the higher order rational functional transformation per bin based on augmentative inputs.

3. The method of claim 1, further comprising combining at least one of an a priori SNR estimate and an a posteriori SNR estimate with one or more of the transformed spectral magnitudes.

4. The method of claim 1, further comprising combining signal power level difference (SPLD) data with one or more of the transformed spectral magnitudes.

5. The method of claim 1, further comprising calculating a corrected spectral magnitude of the reference channel based on a noise magnitude estimate and a noise power level difference (NPLD); and calculating a corrected spectral magnitude of the primary channel based on the noise magnitude estimate and the NPLD.

6. The method of claim 1, wherein transforming one or more of the spectral magnitudes for one or more frequency bins further comprises one or more of:

renormalizing one or more of the spectral magnitudes;

exponentiating one or more of the spectral magnitudes;

temporal smoothing of one or more of the spectral magnitudes;

frequency smoothing of one or more of the spectral magnitudes;

VAD-based smoothing of one or more of the spectral magnitudes;

psychoacoustic smoothing of one or more of the spectral magnitudes;

combining an estimate of a phase difference with one or more of the transformed spectral magnitudes; and combining a VAD-estimate with one or more of the transformed spectral magnitudes.

7. The method of claim 1, further comprising at least one of replacing one or more of the spectral magnitudes by weighted averages taken across neighboring frequency bins within a frame and replacing one or more of the spectral magnitudes by weighted averages taken across corresponding frequency bins from previous frames.

8. The method of claim 1, further comprising:

modeling a probability density function (PDF) of a fast Fourier transform (FFT) coefficient for each of the primary channel and the reference channel of the audio signal;

maximizing at least one of a single channel PDF and a joint channel PDF to provide a discriminative relevance difference (DRD) between a noise magnitude estimate of the reference channel and a noise magnitude estimate of the primary channel.

9. A method for processing an audio signal comprising:

obtaining a primary channel of an audio signal with a primary microphone of an audio device; obtaining a reference channel of the audio signal with a reference microphone of the audio device;

estimating a spectral magnitude of the primary channel of the audio signal; estimating a spectral magnitude of the reference channel of the audio signal;

modeling a probability density function (PDF) of a fast Fourier transform (FFT) coefficient of the primary channel of the audio signal;

modeling a probability density function (PDF) of a fast Fourier transform (FFT) coefficient of the reference channel of the audio signal;

maximizing at least one of a single channel PDF and a joint channel PDF to provide a discriminative relevance difference (DRD) between a noise magnitude estimate of the reference channel and a noise magnitude estimate of the primary channel;

determining which of the spectral magnitudes is greater for a given frequency;

emphasizing the primary channel when the spectral magnitude of the primary channel is stronger than the spectral magnitude of the reference channel;

deemphasizing the primary channel when the spectral magnitude of the reference channel is stronger than the spectral magnitude of the primary channel;

wherein the emphasizing and deemphasizing include computing a multiplicative resealing factor and applying the multiplicative resealing factor to a gain computed in a prior stage of a speech enhancement filter chain when there is a prior stage, and directly applying a gain when there is no prior stage; and wherein the emphasizing and deemphasizing adjust a degree of filtering to isolate voice data from the audio signal and to thereby enhance output of the voice data.

10. The method of claim 9, wherein the multiplicative rescaling factor is used as a gain.

11. The method of claim 9, further comprising including an augmentative input with each spectral frame of at least one of the primary and reference audio channels.

12. The method of claim 11, wherein the augmentative input comprises estimates of an a priori SNR and an a posteriori SNR in each bin of the spectral frame for the primary channel.

13. The method of claim 11, wherein the augmentative input comprises estimates of the per-bin NPLD between corresponding bins of the spectral frames for the primary channel and the reference channel.

14. The method of claim 11, wherein the augmentative input comprises estimates of the per-bin SPLD between corresponding bins of the spectral frames for the primary channel and reference channel.

15. The method of claim 11, wherein the augmentative input comprises estimates of a per frame phase difference between the primary channel and the reference channel.

16. An audio device, comprising:

a primary microphone for receiving an audio signal and for communicating a primary channel of the audio signal;

a reference microphone for receiving the audio signal from a different perspective than the primary microphone and for communicating a reference channel of the audio signal; and at least one processing element for processing the audio signal to filter and or clarify voice data in the audio signal, the at least one processing element being configured to execute a program for effecting a method comprising:

obtaining a primary channel of an the audio signal with a primary microphone of an audio device;

obtaining a reference channel of the audio signal with a reference microphone of the audio device;

estimating a spectral magnitude of the primary channel of the audio signal;

estimating a spectral magnitude of the reference channel of the audio signal;

modeling a probability density function (PDF) of a fast Fourier transform (FFT) coefficient of the primary channel of the audio signal;

modeling a probability density function (PDF) of a fast Fourier transform (FFT) coefficient of the reference channel of the audio signal;

maximizing at least one of a single channel PDF and a joint channel PDF to provide a discriminative relevance difference (DRD) between a noise magnitude estimate of the reference channel and a noise magnitude estimate of the primary channel;

determining which of the spectral magnitudes of the primary and reference channels is greater for a given frequency;

emphasizing the primary channel when the spectral magnitude of the primary channel is stronger than the spectral magnitude of the reference channel;

deemphasizing the primary channel when the spectral magnitude of the reference channel is stronger than the spectral magnitude of the primary channel;

wherein the emphasizing and deemphasizing include computing a multiplicative rescaling factor and applying the multiplicative resealing factor to a gain computed in a prior stage of a speech enhancement filter chain when there is a prior stage, and directly applying a gain when there is no prior stage; and wherein the emphasizing and deemphasizing adjust a degree of filtering to isolate the voice data in the audio signal and to thereby enhance output of the voice data.

17. An audio device, comprising:

a primary microphone for receiving an audio signal and for communicating a primary channel of the audio signal;

a reference microphone for receiving the audio signal from a different perspective than the primary microphone and for communicating a reference channel of the audio signal; and at least one processing element for processing the audio signal to filter and or clarify the audio signal, the at least one processing element being configured to execute a program for effecting a method comprising:

obtaining a primary channel of an audio signal with a primary microphone of an audio device;

obtaining a reference channel of the audio signal with a reference microphone of the audio device;

estimating spectral magnitudes of the primary channel and of the reference channel of the audio signal for a plurality of frequency bins; and transforming one or more of the spectral magnitudes of the primary channel and of the reference channel for one or more frequency bins by applying at least one of a fractional linear transformation and a higher order rational functional transformation to produce one or more transformed spectral magnitudes of the primary channel and of the reference channel;

emphasizing the primary channel when the transformed spectral magnitude of the primary channel is stronger than the transformed spectral magnitude of the reference channel;

deemphasizing the primary channel when the transformed spectral magnitude of the reference channel is stronger than the transformed spectral magnitude of the primary channel;

wherein the emphasizing and deemphasizing include computing a multiplicative rescaling factor and applying the multiplicative rescaling factor to a gain computed in a prior stage of a speech enhancement filter chain when there is a prior stage, and directly applying a gain when there is no prior stage; and wherein the emphasizing and deemphasizing adjust a degree of filtering to isolate the voice data in the audio signal and to thereby enhance output of the voice data.

18. The device of claim 17, wherein transforming one or more of the spectral magnitudes of the primary channel and of the reference channel for one or more frequency bins comprises one or more of:

renormalizing one or more of the spectral magnitudes;

exponentiating one or more of the spectral magnitudes;

temporal smoothing of one or more of the spectral magnitudes;

frequency smoothing of one or more of the spectral magnitudes;

VAD-based smoothing of one or more of the spectral magnitudes;

psychoacoustic smoothing of one or more of the spectral magnitudes;

combining an estimate of a phase difference with one or more of the transformed spectral magnitudes; and combining a VAD-estimate with one or more of the transformed spectral magnitudes.

19. A method for processing an audio signal comprising:

obtaining a primary channel and a secondary channel of an audio signal with multiple microphones of an audio device;

estimating spectral magnitudes of the primary channel and of the secondary channel of the audio signal;

emphasizing the primary channel when the spectral magnitude of the primary channel is stronger than the spectral magnitude of the secondary channel for a given frequency;

deemphasizing the primary channel when the spectral magnitude of the secondary channel is stronger than the spectral magnitude of the primary channel for a given frequency; and wherein the emphasizing and deemphasizing include computing a multiplicative rescaling factor and applying the multiplicative rescaling factor to a gain computed in a prior stage of a speech enhancement filter chain when there is a prior stage; and directly applying a gain when there is no prior stage; and wherein the emphasizing and deemphasizing adjust a degree of filtering to isolate voice data in the audio signal and to thereby enhance output of the voice data.

20. Then method for processing an audio signal of claim 19, further comprising:

transforming one or more of the spectral magnitudes for one or more frequency bins by applying at least one of a fractional linear transformation and a higher order rational functional transformation to produce one or more transformed spectral magnitudes.

* * * * *